US005435469A

United States Patent [19]

Gager et al.

[11] Patent Number: 5,435,469

[45] Date of Patent: Jul. 25, 1995

[54] PUMP FOR COMPRESSION SPRAYERS

[75] Inventors: Steven J. Gager, Kentwood; Paul D. Hurley, Holland, both of Mich.

[73] Assignee: H. D. Hudson Manufacturing Company, Chicago, Ill.

[21] Appl. No.: 218,767

[22] Filed: Mar. 28, 1994

[51] Int. Cl.[6] ..... B65D 83/00

[52] U.S. Cl. ..... 222/402

[58] Field of Search ..... 222/340, 401, 402, 384

[56] References Cited

U.S. PATENT DOCUMENTS 2,256,113 9/1941 Gray ..... 222/402

3,091,372 5/1963 Tidd ..... 222/401

FOREIGN PATENT DOCUMENTS 495973 10/1952 Italy ..... 222/402

*Primary Examiner*—Gregory L. Huson

*Attorney, Agent, or Firm*—Kane, Dalsimer, Sullivan, Kurucz, Levy, Eisele & Richard

[57] ABSTRACT

A pump assembly for a compression sprayer includes a cylinder and a piston reciprocal therein with means for releasably latching the piston in its fully inserted position. An integral cup and spring are coupled with the inner end of the piston with the spring biased against the inner end of the cylinder to cooperate in urging the piston outwardly to maintain the piston in its latched position.

11 Claims, 4 Drawing Sheets

PUMP FOR COMPRESSION SPRAYERS

BACKGROUND OF THE INVENTION

The present invention relates to compression sprayers for spraying under pressure sprayable solutions including pesticides, insecticides, agricultural and garden chemicals and the like, and more particularly to a sprayer in which the pump assembly is removably mounted in the fill opening of the tank.

Compression sprayers operate under air pressure collected in the tank and generated by intermittent activation of a pump whereby spraying may be continuously effected over a substantial period of time or until the pressure in the tank is sufficiently decreased as to require the operator to again manipulate the pump to build up sufficient operating air pressure in the tank.

To maintain the air pressure generated in the tank against leakage, the pump assembly is sealed in the tank and such seal is effective until the pump assembly is to be removed either after spraying has been completed or when the contents of the tank has been depleted and must be replenished.

Upon pressurizing the tank and during spraying, the pump is normally latched in its fully inserted position to effectively prevent the pump from inadvertently releasing or interfering with the spraying operation.

SUMMARY OF THE INVENTION

A principal object of the present invention is to provide an improved pump assembly for compression sprayers.

Another object is to provide an improved biasing means for urging the piston of the pump assembly to its retracted position to thereby assure maintaining the piston in its inserted releasably latched position.

Other objects and advantages will become apparent from the following detailed description which is to be taken in conjunction with the accompanying drawings.

DETAILED DESCRIPTION OF THE PREFERRED EMBODIMENTS

Figure 1:
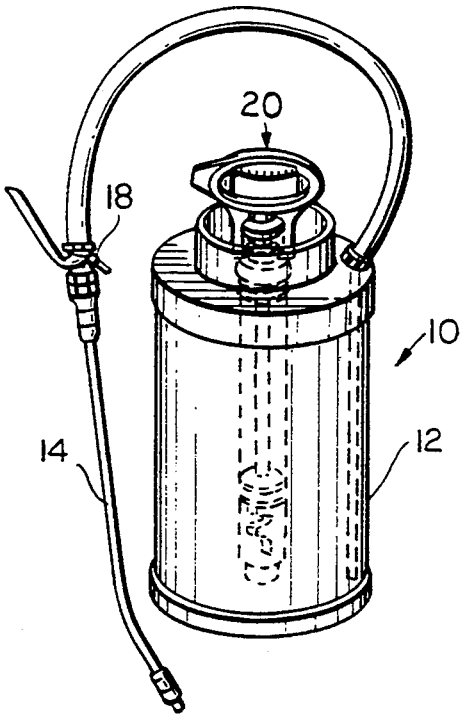
FIG. 1 is a perspective view of an assembled compression sprayer embodying the pump assembly of the present invention.
Figure 2:
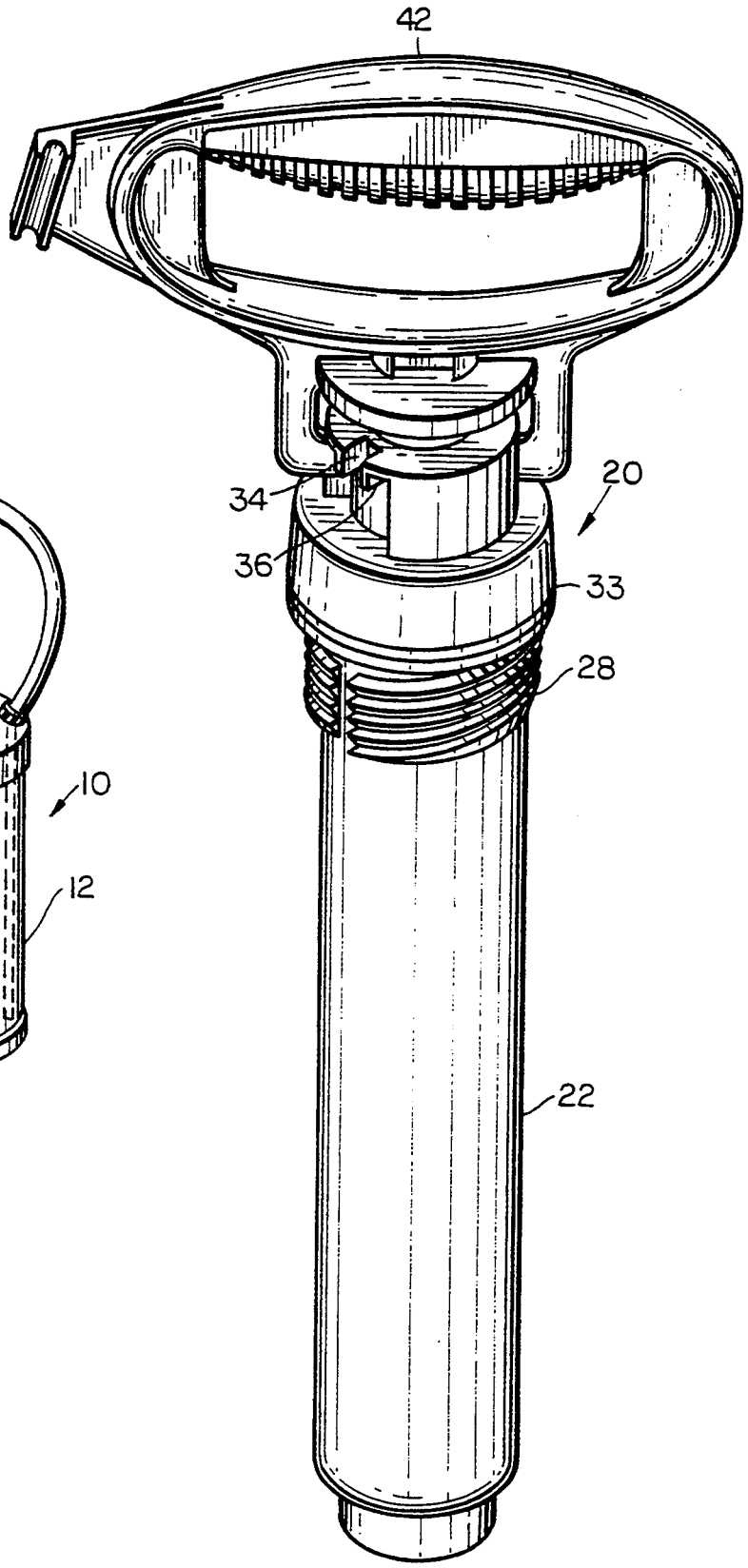
FIG. 2 is a perspective view of the pump assembly of this invention.
Figure 3:
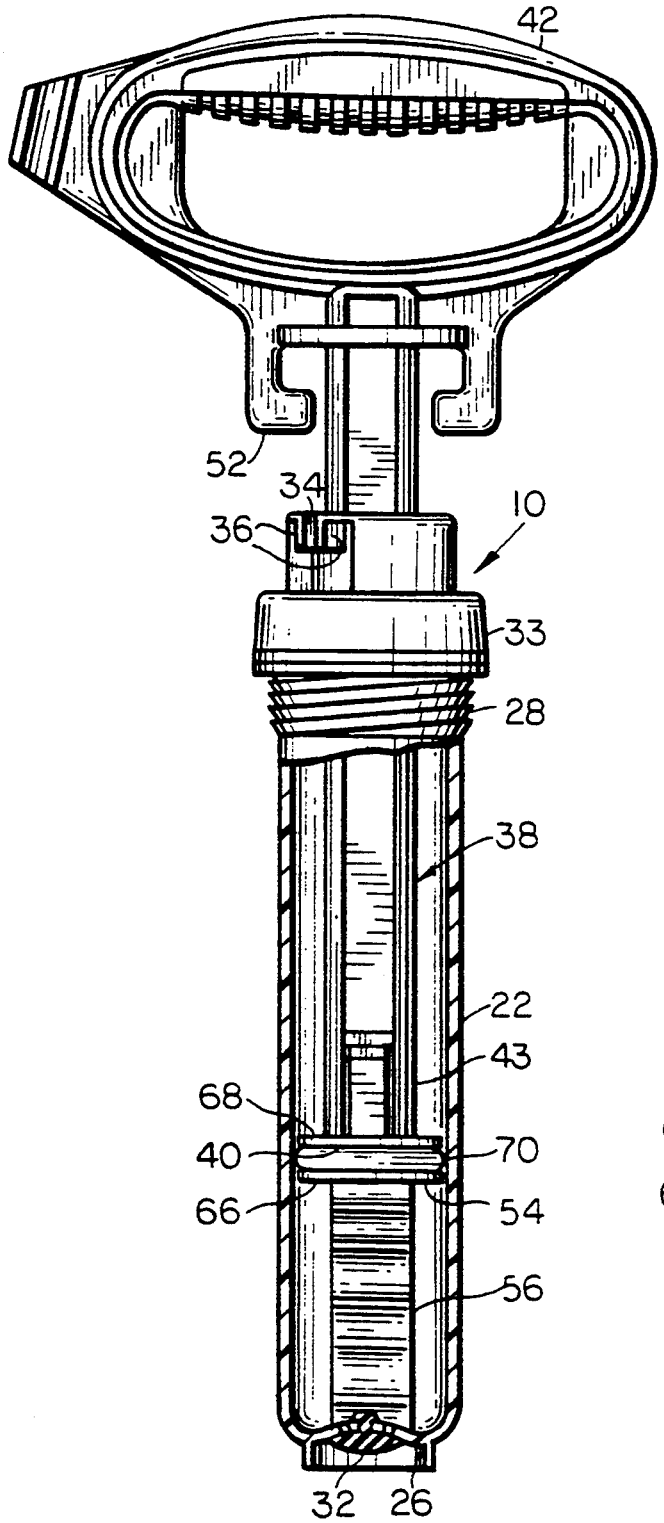
FIG. 3 is a front elevational view, partly in section, of the pump assembly with the spring relaxed.
Figure 4:
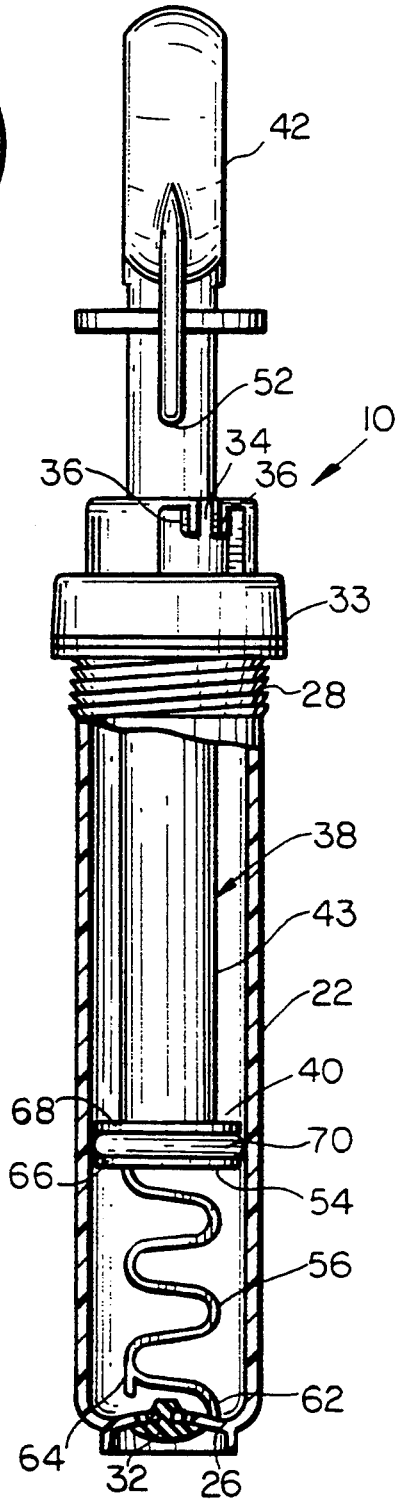
FIG. 4 is a side elevational view of the pump assembly of FIG. 3.
Figure 5:
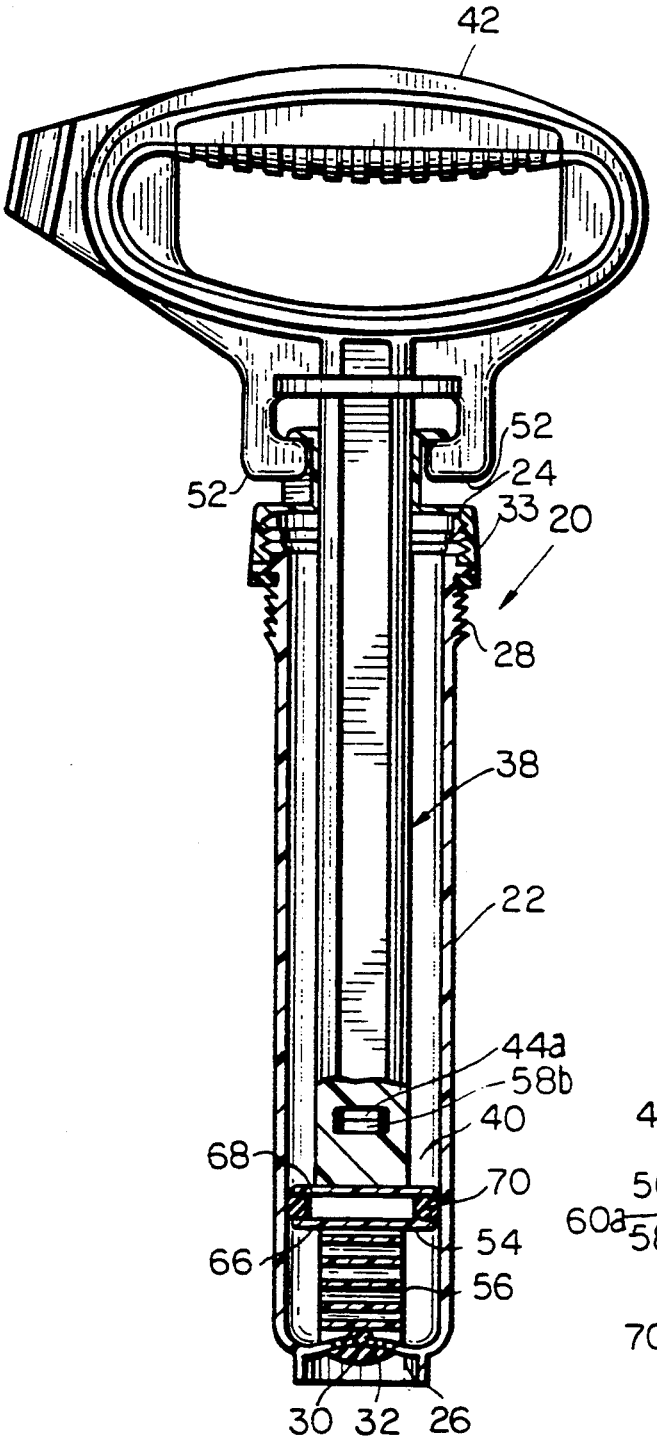
FIG. 5 is a front elevational view, partly in section, of the pump assembly with the spring compressed piston releasably latched.
Figure 6:
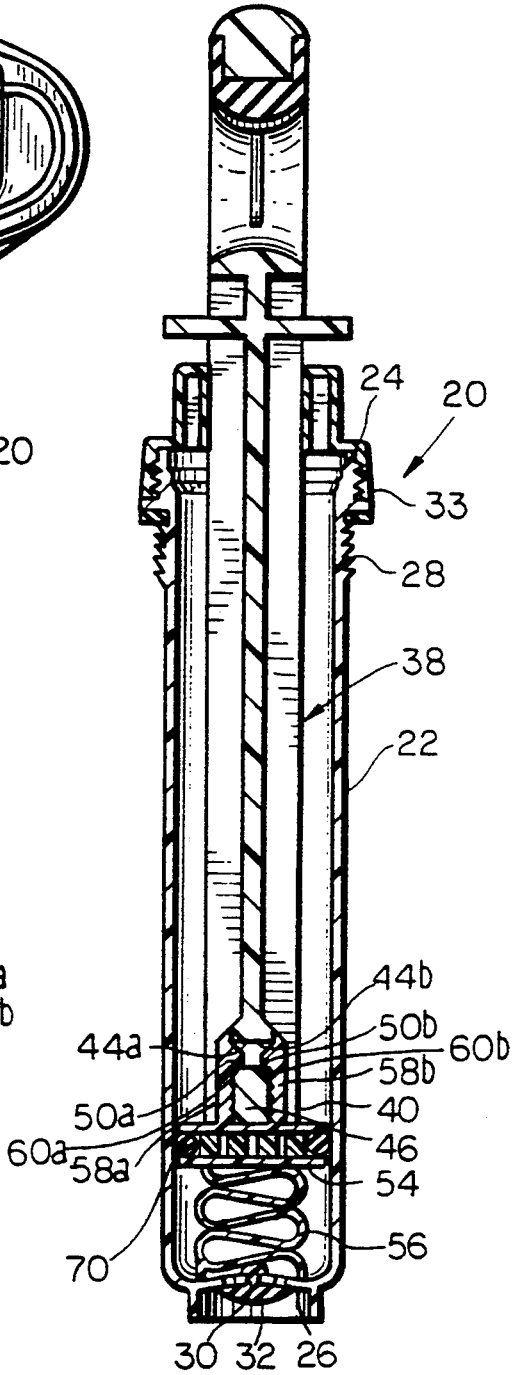
FIG. 6 is a side elevational view of the pump assembly of FIG. 5.
Figure 7:
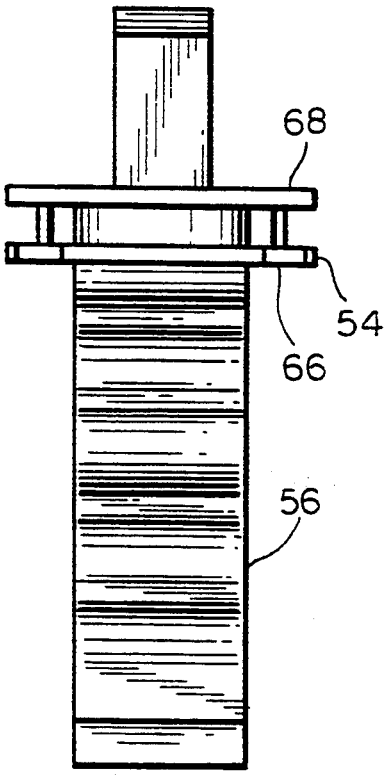
FIG. 7 is a front elevational view of the spring and piston cup subassembly.
Figure 8:
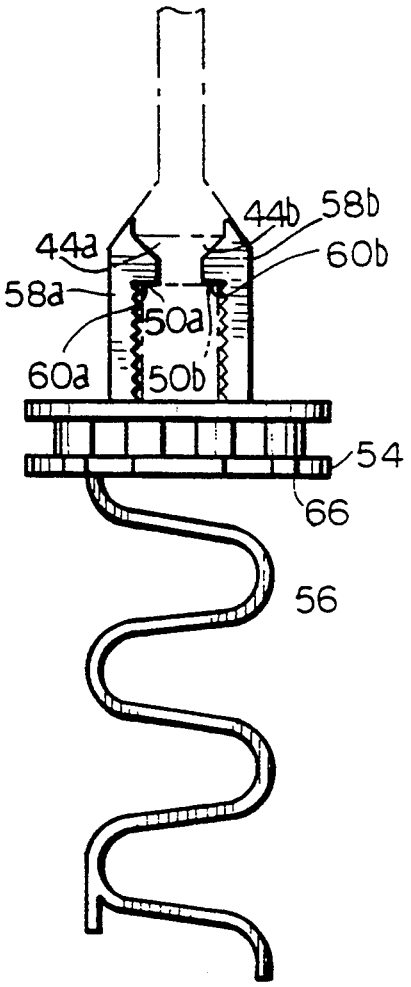
FIG. 8 is a side elevational view of the spring and piston cup subassembly.
Figure 9:
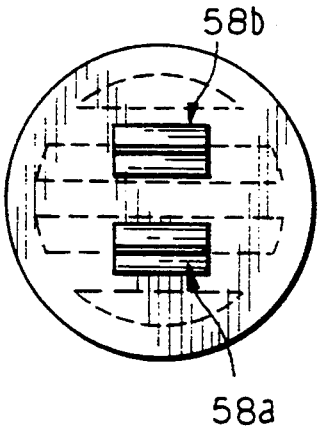
FIG. 9 is a top plan view of the spring and piston cup assembly.

In the drawings, the compression sprayer 10 of the present invention comprises a tank 12 for containing a liquid or spray solution to be dispensed in a desired or selected spray pattern under pressure through a discharge tube 14 having an adjustable spray nozzle with the discharge controlled by a manually-operated valve 18.

Mounted in depending position in a fill or access opening in the tank 12 in any conventional manner well known in the art is a pump assembly 20. In this regard, reference is also made to commonly assigned U.S. Pat. Nos. 3,121,518 and 3,584,769. Pump assembly 20 includes cylinder 22 having an outer extremely threaded open end 24 and inner closed end 26. In the illustrated embodiment the outer end 24 includes threads 28 that mate with complimentary threads at the fill opening of the tank 12 for releasably locking the pump assembly across the access opening of the tank 12. The inner closed end 26 includes an axial opening 30 having anchored therein an umbrella valve 32 which opens to introduce compressed air from the pump assembly 20 into the interior of the tank upon activation of the pumping action, and close to maintain the pressure in the tank upon cessation of the pumping action. The outer end 24 of the cylinder 22 also receives internally threaded cap 33 which includes opposed slots 34 which receives latching surfaces of the piston and latching flanges 36 that latch with surfaces of the piston to releasably latch the piston in its fully inserted inner position.

Reference is now made to the piston 38 of the pump assembly 20 having an inner end 40 and a gripping handle 42 at its outer end with an interposed integrally molded piston rod or shaft 43. The inner end is formed with a pair of opposed openings **44*a* and 44*b* communicating with a central post 46. The post has shoulders or ledges 50*a* and 50*b*, respectively, aligned with the openings 44*a* and 44*b*. At the base of the handle 42 are a pair of opposed downwardly depending lugs 52 which are adapted to enter slots 34 and be turned under flange 36** to releasably latch the piston in its fully inserted position.

In order to cooperate in maintaining the piston 30 in its fully inserted releasably latched position, the base 40 of the piston has coupled therewith a cup 54 and spring 56. The cup 54 is attached to the base of the piston by a pair of opposed up- standing arms **58*a* and 58*b* each having an inner shoulder 60*a* and 60*b* that engage with ledges 50*a* and 50*b* of the post 46. In this regard, arms 58*a* and 58*b* are adapted to flex outwardly to permit shoulders 60*a* and 60*b* to override surfaces of the post 46 and eventually snap into recesses 44*a* and 44*b*. The spring 56 is serpentine in fashion and its lower end 62 together with projection 64 straddle valve 32 and rest on the inner surfaces of the closed end 26 of cylinder 22. The cup 54 is provided with a pair of spaced flanges 66 and 68 which conveniently receive O-ring 70 which engages and seals with the inner surfaces of cylinder 22. The cup 54 and spring 56** are advantageously injection molded as a single unit.

In use the cap 33 on the outer end 24 of cylinder 22 is secured across the access opening at the top of tank 12 after the tank was filled to a certain level while providing sufficient headspace, with liquid to be dispensed. The pump is activated by first turning handle 42 to free lugs 52 from the flanges 36 so that lugs 52 may be retracted from the slots 34. The piston is then systematically retracted and then inserted and depressed. With each insertion of the piston the seal between O-ring 70 and inner surfaces of the cylinder 22 will increase the air pressure in the pump chamber to force valve 32 open to introduce the air under pressure into the headspace in the tank 12. When the pressure within tank 12 has reached a sufficient level the lugs are inserted into slides 34 and latched behind flanges 36. The liquid in the tank may then be sprayed. This procedure is repeated until the desired spraying has been completed.

Thus, the several aforenoted objects and advantages are most effectively attained. Although a single somewhat preferred embodiment has been disclosed and described in detail herein, it should be understood that the invention is in no sense limited thereby and its scope is to be determined by that of the appended claims.

What is claimed is:

1. A pump assembly for a compression sprayer comprising:

a cylinder having a closed inner end and an open outer end and a tubular sidewall interposed therebetween, the closed inner end having an opening and a valve disposed across the opening;

a cap coupled with the outer end of the cylinder;

a reciprocal piston in the cylinder having an inner end and an outer end, an outer handle and a shaft interposed between the handle and piston, the piston being reciprocal between an inserted position and a retracted position during a pumping cycle;

interengaging surfaces of the outer end of the cap and handle forming releasable latching means for releasably latching the piston in a fully inserted position in the cylinder;

the piston having a cup and spring depending therefrom interposed between the cup and cylinder inner end for biasing the piston away from the cylinder inner end and cooperating in maintaining the piston in its releasably latched position, and means for coupling the cup to the inner end of the piston.

2. The invention in accordance with claim 1 wherein the piston outer end, handle, shaft and inner end are molded as a unit.

3. The invention in accordance with claim 1 wherein the cup and spring are molded as a unit.

4. The invention in accordance with claim 1 wherein the releasable latching means includes a pair of opposed slots in the cap and flanges adjacent the slots, and a pair of lugs at the outer end of the piston with the lugs adapted to be inserted in the slots and into engagement with the flanges upon turning the handle, to releasably latch the piston in its fully inserted position.

5. The invention in accordance with claim 1 wherein the means for coupling the cup to the inner end of the piston comprises a pair of opposed recesses and a post having ledges aligned with the recesses, and the cup having a pair of opposed arms having a shoulder thereon, the arms adapted to be inserted in the recesses of the piston inner end and flexed outwardly over the post and the shoulders are adapted then to be snap fitted over the ledges.

6. The invention in accordance with claim 1 wherein the cup includes a pair of spaced flanges and an O-ring is interposed between the flanges and adapted to sealingly engage inner walls of the cylinder.

7. The invention in accordance with claim 1 wherein the spring is serpentine in configuration and includes a lower end and a lower projection which straddle the valve and engage the inner end of the cylinder.

8. The invention in accordance with claim 7 wherein the cup and spring are molded as a unit;

the means for coupling the cup to the inner end of the piston comprises a pair of opposed recesses and a post having ledges aligned with the recesses, and the cup having a pair of opposed arms having a shoulder thereon, the arms adapted to be inserted in the recesses of the piston inner end and flexed outwardly over the post and the shoulders are adapted then to be snap fitted over the ledges; and the cup includes a pair of spaced flanges and an O-ring is interposed between the flanges and adapted to releasably engage inner walls of the cylinder.

9. The invention in accordance with claim 8 wherein the piston outer end, handle, shaft and inner end are molded as a unit; and the releasable latching means includes a pair of opposed slots in the cap and flanges adjacent the slots, and a pair of lugs at the outer end of the piston with the lugs adapted to be inserted in the slots and into engagement with the flanges upon turning the handle, to releasably latch the piston in its fully inserted position.

10. In a compression sprayer having the pump assembly of claim 9, further including a tank for liquid to be sprayed, the tank having an access opening with the pump assembly coupled across the access opening, a discharge tube in communication with the liquid in the tank and having a discharge nozzle and a valve for controlling the discharge from the nozzle.

11. In a compression sprayer having the pump assembly of claim 1 further including a tank for liquid to be sprayed, the tank having an access opening with the pump assembly coupled across the access opening, a discharge tube in communication with the liquid in the tank and having a discharge nozzle and a valve for controlling the discharge from the nozzle.

* * * * *